US005729820A

United States Patent [19]

Jamzadeh et al.

[11] Patent Number: 5,729,820

[45] Date of Patent: Mar. 17, 1998

[54] METHOD AND APPARATUS FOR PRODUCING HIGH QUALITY GREETING CARDS OR THE LIKE

[75] Inventors: Feraydoon Shahjahan Jamzadeh, Fairport; James Raymond Flick; David James Reed, both of Rochester, all of N.Y.

[73] Assignee: Eastman Kodak Company, Rochester, N.Y.

[21] Appl. No.: 661,675

[22] Filed: Jun. 11, 1996

[51] Int. Cl.[6] ..... G03G 21/00

[52] U.S. Cl. ..... 399/407; 399/298; 399/411

[58] Field of Search ..... 399/361, 407, 399/411, 298; 283/117

[56] References Cited

U.S. PATENT DOCUMENTS 3,855,890 12/1974 Lynch et al. .
4,270,911 6/1981 McNew .
4,406,649 9/1983 Yamamura .
4,592,651 6/1986 Oikawa et al. .
4,640,611 2/1987 Ohdake et al. .
4,900,391 2/1990 Mandel et al. .
5,072,253 12/1991 Patton .
5,257,081 10/1993 Kato et al. .
5,335,005 8/1994 Sellers et al. .
5,459,819 10/1995 Watkins .
5,493,378 2/1996 Jamzadeh et al. .
5,581,339 12/1996 Jamzadeh et al. .
5,581,343 12/1996 Choydry et al. .
5,585,910 12/1996 Jamzadeh et al. .

*Primary Examiner*—R. L. Moses
*Attorney, Agent, or Firm*—Norman Rushefsky

[57] ABSTRACT

A method and apparatus for producing high quality folded greeting cards or the like is described as is a package of receiver sheet stock used for making such cards. A toned image is formed on an image supporting member using preferably an electrostatographic recording apparatus. A discrete receiver sheet is fed into engagement with the image supporting member to transfer the image to the receiver sheet. The receiver sheet is of a card stock of the type having a weight of no less than 28# bond. The grain of the sheet is in the grain short direction and the receiver sheet is fed into transfer relationship with the image supporting member by movement of the sheet in a direction coincident with the direction of the longer edges of the sheet. The receiver sheet is further characterized by one or more scoring lines which extend generally parallel to and intermediate the shorter edges of the sheet to facilitate folding of the receiver sheet after formation of an image thereon. The image on the image supporting member is transferred to the receiver sheet and then fused. A quality fold is provided to the card by folding the card with a fold line being along the scoring line(s). A further finishing of the card may be made by trimming of border areas.

30 Claims, 5 Drawing Sheets

METHOD AND APPARATUS FOR PRODUCING HIGH QUALITY GREETING CARDS OR THE LIKE

CROSS-REFERENCE TO RELATED APPLICATIONS

This application is related to commonly assigned U.S. application Ser. Nos. 08/281,332 and 08/281,282.

BACKGROUND OF THE INVENTION

The invention relates to apparatus and methods for making high quality folded greeting cards or the like without the need for expensive finishing equipment.

DESCRIPTION RELATIVE TO THE PRIOR ART

In the manufacture of greeting cards, announcement cards or the like, appearance of the finished cards are of utmost concern. The most important factors affecting the card are obviously image content, quality of the reproduction and card stock. A secondary, but still important consideration distinguishing higher quality cards from lesser quality cards, is the quality of the fold between the leaves of the card. Typically, high quality greeting cards are made by printing on card stock. A typical card stock may have a bond weight of say 59#. The printed card stock is then scored where a fold line is to be made and then folded and trimmed at the edges. The scoring is made to provide sharp, clean fold edges which enhances card appearance.

As consumers demand more individualized card content, the necessity for short runs of cards becomes necessary as does the location of card producing equipment in locations made accessible to consumers. Thus, a trend is apparent towards more inexpensive card production equipment suited for short runs. The use of color electrophotographic equipment for producing short runs of greeting cards would appear to be an ideal answer. However, factors militating against use of more diverse production locations are the cost associated with finishing of the cards.

The invention is thus directed to facilitating the use of greeting card production using electrostatographic recording apparatus or other inexpensive recording apparatus such as ink jet recorders wherein quality finished folded cards can be produced.

SUMMARY OF THE INVENTION

These and other objects and advantages which will become apparent after reading this specification are realized by a method for producing high quality folded printed card, the method comprising: forming a toned electrostatographic image on an image supporting member of an electrostatographic recording apparatus; feeding a discrete receiver sheet into engagement with the image supporting member for transfer of the image to the receiver sheet, the receiver sheet being of a card stock of the type having a weight of no less than 28# (112 grams per square meter or 112 g/m$^2$) bond and having a pair of generally parallel first longer edges longer than a pair of generally parallel second shorter edges located generally perpendicular to the first edges, the grain of the sheet being in the grain short direction and the receiver sheet being fed into transfer relationship with the image supporting member by movement of the sheet in a direction coincident with the direction of the longer edges of the sheet, the receiver sheet including a score line which extends generally parallel to and intermediate the shorter edges to facilitate folding of the receiver sheet after formation of an image thereon; transferring the image on the image supporting member to the receiver sheet; fusing the image transferred to the receiver sheet; and folding the receiver sheet or a portion thereof having a border area removed with a fold line being along the score line.

In accordance with a second aspect of the invention, there is provided a package of receiver sheets adapted for use in the above method, the package comprising: a plurality of discrete receiver sheets arranged in a stack wherein each receiver sheet is of a card stock of the type having a weight of no less than 28# bond and having a pair of generally parallel first longer edges longer than a pair of generally parallel second shorter edges located generally perpendicular to the first edges, the grain of the sheet being in the grain short direction, the receiver sheet including a score line which extends generally parallel to and intermediate the shorter edges to facilitate folding of the receiver sheet after formation of an image thereon to form a high quality folded card.

In accordance with a third aspect of the invention, there is provided a recording apparatus, comprising: means for forming a toned electrostatographic image on an image supporting member of an electrostatographic recording apparatus; a stack of discrete receiver sheets, each receiver sheet being of a card stock of the type having a weight of no less than 28# bond and having a pair of generally parallel first longer edges longer than a pair of generally parallel second shorter edges located generally perpendicular to the first edges, the grain of the sheet being in the grain short direction and including a score line which extends generally parallel to and intermediate the shorter edges to facilitate folding of the card stock after formation of an image thereon; means for feeding discrete receiver sheets from the stack of such receiver sheets into engagement with the image supporting member, the feeding means being operative to feed each receiver sheet into transfer relationship with the image supporting member by movement of the sheet in a direction coincident with the direction of the longer edges of the sheet; means for transferring the image on the image supporting member to the receiver sheet; and means for fusing the image transferred to the receiver sheet.

In accordance with a fourth and fifth aspect of the invention there is provided a method for producing high quality folded cards and a package of receiver sheets for use in such method, the method comprising: forming an image upon a discrete receiver sheet, the receiver sheet being of a card stock of the type having a weight of no less than 28# bond, the receiver sheet including a score line to facilitate folding of the receiver sheet after formation of the image thereon; and folding the receiver sheet or a portion thereof having a border area removed with a fold line being along the scoring line.

DESCRIPTION OF THE PREFERRED EMBODIMENTS OF THE INVENTION

Figure 1:
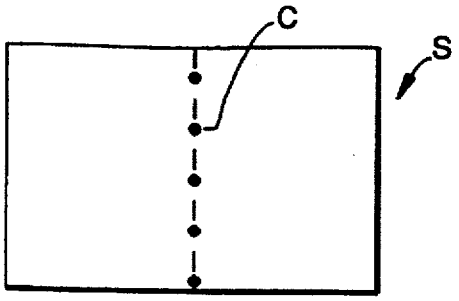
FIG. 1 is a planar view of a pre-scored card stock used as a discrete receiver sheet in the invention.

Referring now to FIG. 1, there is shown a pre-scored paper card stock receiver sheet, S, in accordance with the invention. In this preferred example, the receiver sheet, S, is an 11"×17" discrete sheet of blank (i.e. no visible print indicia thereon) card stock that has been pre-scored as shown by the dash dotted line C which is parallel to the shorter edges of the sheet. The sheet is "grain short" which means that the grain of the paper is in a direction parallel to the shorter edges of the sheet. The sheet, S, is preferably of heavy stock having bond weight of no less than 28# bond. An example of a sheet, S, is one having a bond weight of 59# (lb.) bond, a thickness of 11 mils, smoothness of 371 (Sheffield units), and a stiffness of 360 (m-Newton) in the feed direction of the electrophotographic apparatus. Thus, the "grain short" paper being a paper in which the grain is aligned with the short dimension of the sheet is, somewhat, more flexible when bent around an axis parallel to the short dimension of the sheet when the sheet is used as a receiver sheet in an electrostatographic apparatus. This feature provides more flexibility to the sheet itself for following a path when the long dimension of the sheet is parallel or coincident to the in-track direction of the sheet conveyance path of the apparatus and the path has some curves or the sheet is wrapped around a transfer drum or belt having a curved aspect.

Figure 12:
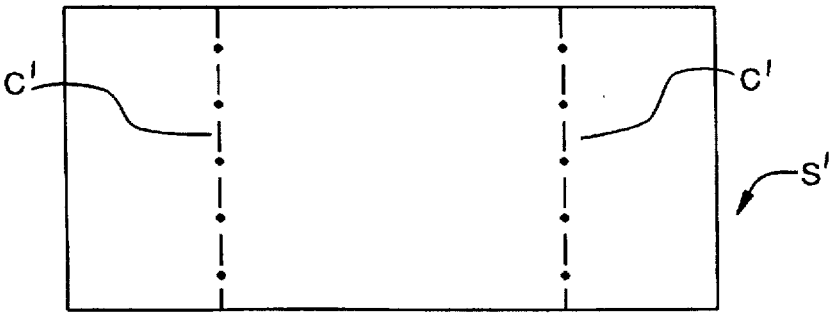
FIG. 12 is a view similar to that of FIG. 1 of a pre-scored card stock used as a discrete receiver sheet in the invention but having two score lines.

In an alternative embodiment illustrated in FIG. 12 a discrete receiver sheet S' is illustrated of say 11"×17" having plural generally parallel pre-scored lines C' which are provided to facilitate folding to form a finished card with three segments the sheet S' is otherwise similar to sheet S and the description herein is also applicable to sheet S'. Preferably, the image area of the segments will be about equal with minor difference in dimension to facilitate folding into each other. The positions of the pre-scored lines will also take into account that preferably no image area is available in the leading ½" and trailing 2½" or other areas not suited for imaging in a particular process or apparatus.

Figure 2:
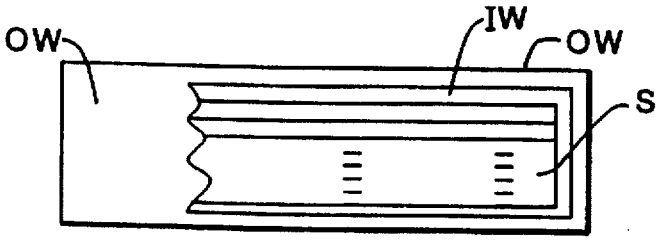
FIG. 2 is an elevation view partially cut away of a package of receiver sheets of the type shown in FIG. 1 and also in accordance with the invention.

With reference now to FIG. 2, there is illustrated a package of say 50 or 100 receiver sheets, S, of the type described in FIG. 1. The receiver sheets are discrete; i.e., unattached to each other, and stacked one upon the other and are packaged after a drying treatment wherein the moisture content by weight of the sheets is reduced to below 10% and preferably between about 5% and about 7%. The sheets, S, after stacking are sealed in a hermetically sealed inner wrapper, IW. The hermetically sealed wrapper may be selected from those used to seal known papers used in the graphic arts industry or other papers sorted for such purpose. Typically, these wrappers are of a plastic material and relatively impervious to moisture after being either heat-sealed or adhesively sealed to form the inner wrapper. An outer wrapper, OW, of say paper, may optionally be provided. Where no outer wrapper is provided, the wrapper providing the hermetic seal functions as both the hermetic seal and has printing on the outside indicating the intended use of the sheets and identifying it as pre-scored card stock. Suitable indicia identifying the intended use may include some or all of the following: weight, grain direction, finish type and an indication that it is used for a plain paper copier or printer and number of score lines.

Figure 3:
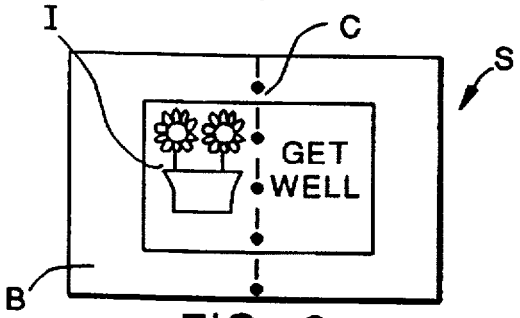
FIG. 3 is the receiver sheet of FIG. 1 after formation of an image thereon in a color electrophotographic process in accordance with the invention.

With reference to FIG. 3, there is shown an illustration of a discrete sheet, S, having an image, I, formed thereon with a border or selvage, B, surrounding the image. The image may be on one or both sides of the sheet and is provided by an electrostatographic recording apparatus such as the electrophotographic apparatus described below.

Figure 4:
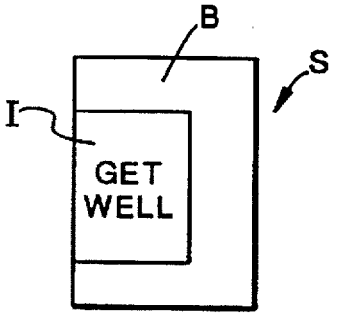
FIG. 4 is the imaged receiver sheet of FIG. 3 folded along the pre-score line in preparation for a trimming operation to remove a border or selvage portion.

In FIG. 4, there is illustrated a folding in-half of the sheet, S, in preparation for trimming of the border B.

Figure 5:
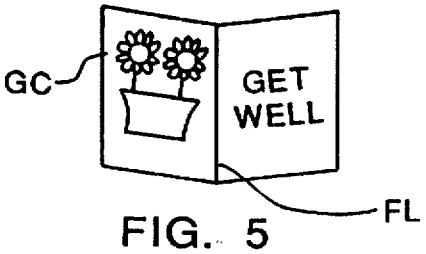
FIG. 5 is the greeting card created after the trimming operation.

In FIG. 5, there is illustrated the finished greeting card, GC, with an appealing fold line, FL, formed by folding along the pre-score line.

A preferred electrophotographic process for creating the greeting card of the invention will now be described. In U.S. Pat. No. 5,459,819, there is described the customization of greeting cards using a KODAK COLOREDGE copier, an example of which is the KODAK COLOREDGE 1550+ Color Copier manufactured by Eastman Kodak Company, Rochester, N.Y. The aforementioned patent discloses an operator at a workstation composing a sheet to be turned into a greeting card. The card is then printed with a copier/printer of the type identified. The system at the workstation would lead the operator through picking out the size of greeting card (including picking where a single sheet should be folded), the background for each side, location of the message which is typed in by the operator, and then the location of the operator's preference of both graphics pulled from memory and photographs that are scanned into the workstation memory.

Alternatively to electronic composing, the color image scanner presently provided on the apparatus referred to can be used to form images from hard copy originals that are scanned into the scanner to generate electronic image signals representing image information on the originals. In this instance, each side of a duplex image to be formed on the receiver sheet is prepared by hand, using cutting and pasting techniques, including the background, the photographic portion, the message portion and whatever else the operator wishes to put in the customized product.

For purposes herein, images on opposite sides of the sheet making up the greeting card will usually be referred to as holding first and second images, respectively, even though the receiving sheet may ultimately be folded and a single image take up more than one page in the final product.

A preferred electrophotographic apparatus and method for forming images on a greeting card will now be described.

Reference is also made to the aforementioned commonly assigned applications.

Figure 6:
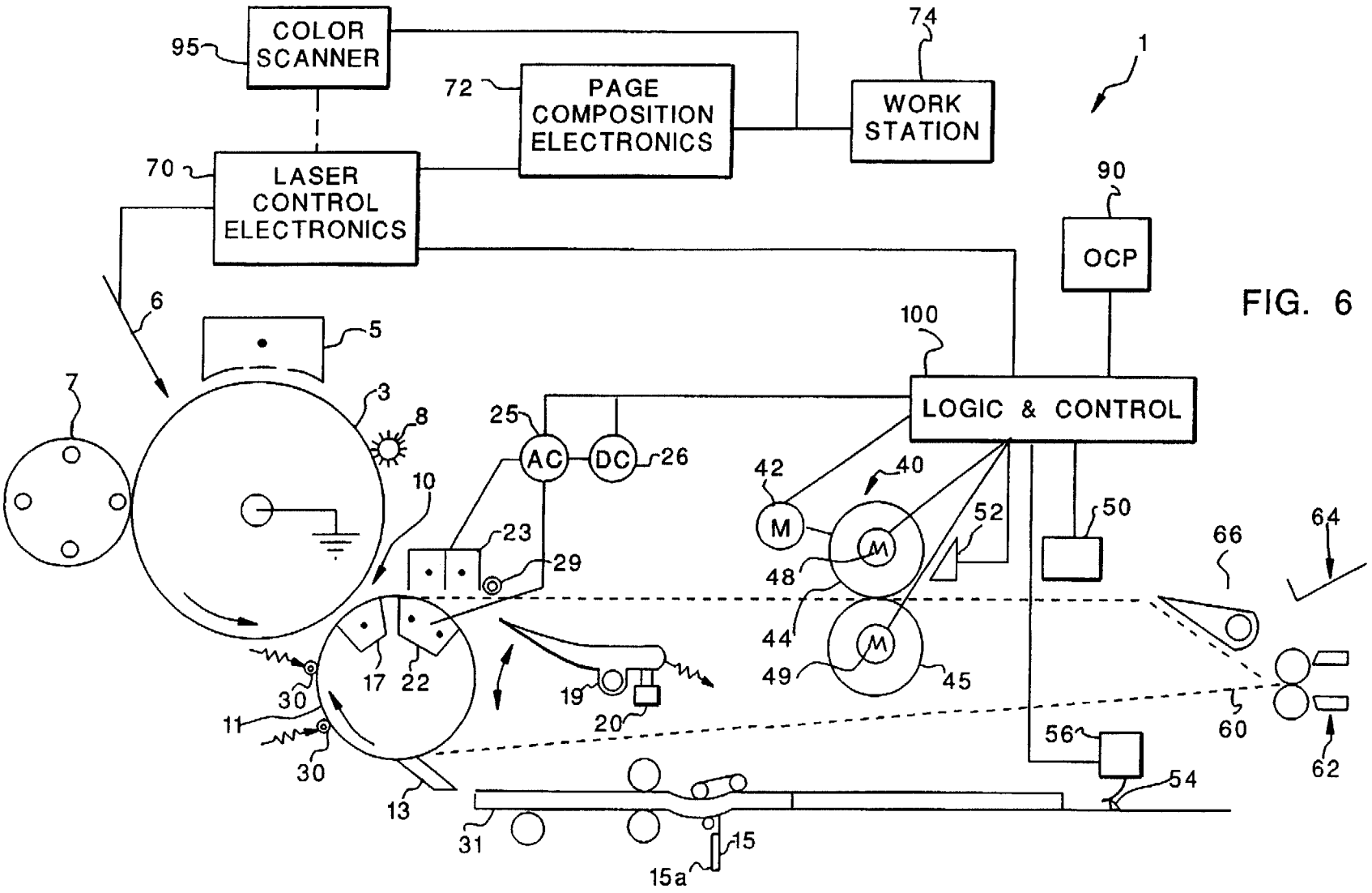
FIG. 6 is a preferred color electrophotographic apparatus for creating greeting card images on the receiver sheets of the type shown in FIG. 1 in accordance with the invention.

Referring to FIG. 6, an image-forming apparatus 1 includes an image member, for example, a photoconductive drum 3, on which toner images are formed conventionally. More specifically, the surface of drum 3 is uniformly charged by a charger 5 and imagewise exposed by exposing means, for example, a laser 6 to create a series of electrostatic images. Each of the electrostatic images is toned by the application of a different colored toner using a toning device 7 which contains four toning stations indexible through toning relation with image member 3.

At the same time, a receiver sheet 31, such as one of those described above as pre-scored sheet, S, is fed from a receiver sheet supply 15 of discrete receiver sheets, S, to the periphery of a transfer member 11. Transfer member 11 is shown as a drum, but could also be an endless belt, both of which are well known in the art for this application.

The leading edge of the receiver sheet 31 is gripped by a suitable holding means, for example, gripping fingers 13. A vacuum or electrostatics could also be used. However, gripper fingers are preferred for this heavier card stock material. Springs urge the gripper fingers into retaining relationship with the drum. As both the transfer drum 11 and the image member 3 are moved through a transfer nip at position 10, an electric field created by a transfer corona 17 or other field generating means transfers one of the toner images to the receiving sheet. As transfer member 11 is continually rotated, the series of different color toner images are transferred in registration to the receiving sheet to create a multicolor image on the sheet. After the desired number of transfers, the receiver sheet is separated from the transfer member 11 by a pivotal skive 19 which is moved into a position against transfer member 11 by a solenoid 20. Image member 3 is continually cleaned by a cleaning device 8 so that the process is continuous.

The receiver sheet 31 with the toner image on one side is now fed to a fuser 40 where a pair of fusing members 44 and 45, for example, conventional rollers internally heated by heaters 48 and 49, apply both pressure and heat to the image to at least partially fix it to the receiving sheet.

The receiver sheet can then be deposited in an output hopper 64. Alternatively, the receiving sheet is fed through a duplex path 60 which includes an inverter 62 back to the transfer member 11 to present the opposite side for receipt of a series of toner images, creating a second multicolor toner image on the reverse, second side of the receiving sheet. The sheet is again separated using separation skive 19 and fed again through the fuser 40 and into the output hopper 64.

Except for the automatic duplex mode of operation, the above very generally describes several different color image forming apparatus in commercial use today, for example, the aforementioned KODAK COLOREDGE 1550+ color copier. Duplex operation can be manually accomplished with these apparatus without the use of an internal duplex path. The apparatus may be modified for handling the card stock material described herein by employing features described herein. Other types of electrostatographic copiers/printers may be used wherein a toned image is transferred to an intermediate recording member and then transferred from the intermediate recording member to a receiver sheet of the type described herein. Thus, a primary recording member and/or an intermediate recording member may be used as an image supporting member that supports a toned unfused electrostatographic image for transfer to a receiver sheet.

U.S. Pat. No. 5,459,819 to Watkins et al, referred to above, describes a system for customized printing of a variety of articles with images obtained from a variety of different sources. In that system a photographic picture can be scanned and combined with graphics already in memory or composed on a screen and a typed in message to form a combined image using a printer also comparable to the color copier identified above. One of the applications suggested for this system is the formation of customized greeting cards in which a portion of an image can come from the scanning of a photograph, another portion can come from suitable background or other graphics stored in memory particularly suitable to greeting cards, and still another portion can be typed in (or graphics composed) at a workstation. The disclosure of this patent is hereby incorporated by reference herein.

In adapting an electrophotographic printer to the greeting card application and other applications comparable to that, a number of improvements in known apparatus is described in the cross-referenced applications. Greeting card stock is typically much stiffer than the normal range of receiver sheet usable in a typical color copier or printer. For example, in the apparatus described in the referenced patents it may be as stiff as typical 60# bond paper. However, the invention described herein may be advantageously used with apparatus that can handle heavier weight and/or stiffer papers. Papers may also be of various known compositions and/or finishes including glossy finishes. Other paper sizes than that referred to herein may also be used. Referring to FIG. 6, this poses its greatest problem in wrapping the receiver sheet around a relatively small transfer member, such as drum 11. It also affects other aspects of movement of the receiving sheet and fusing of the images.

Figure 7:
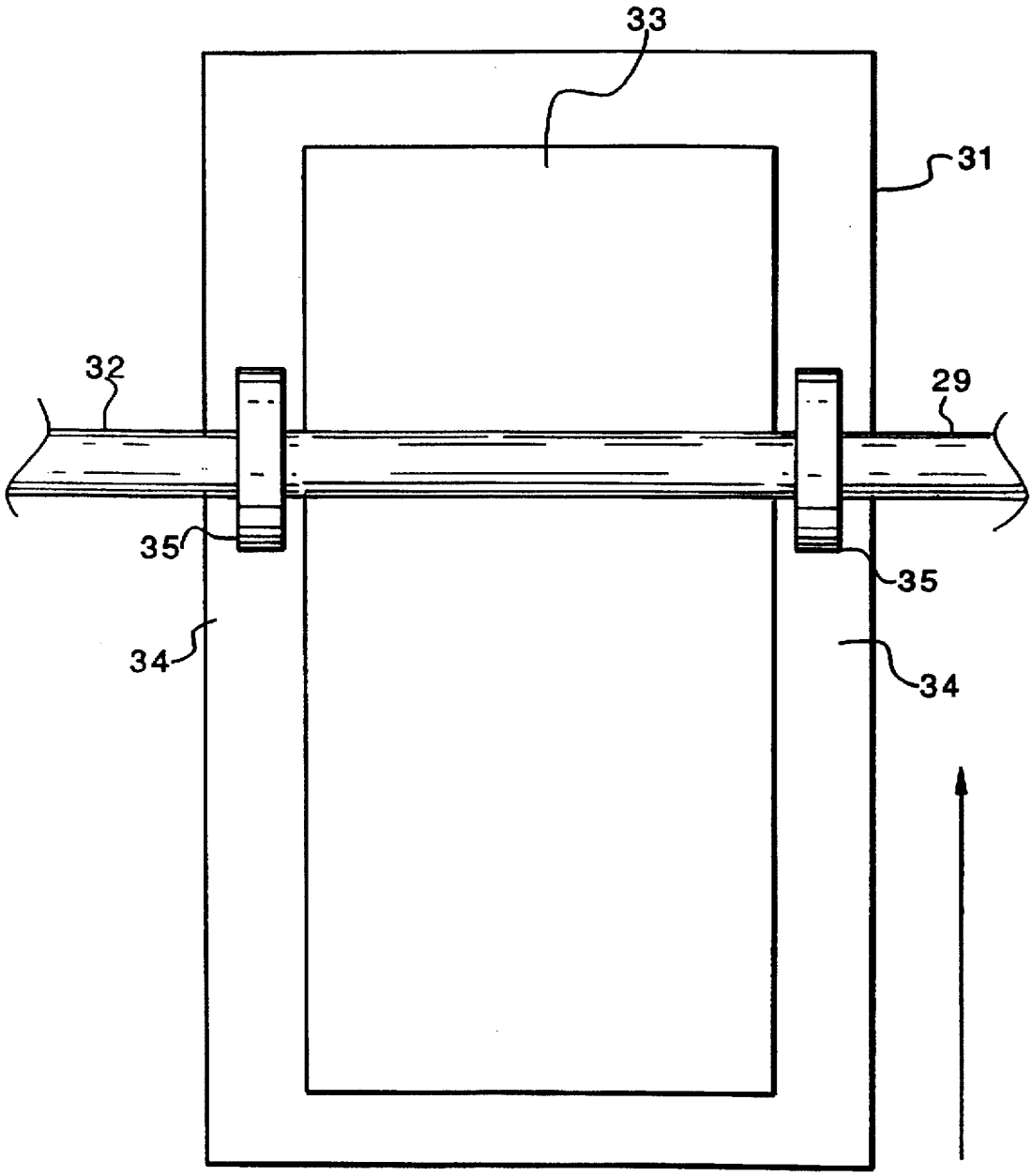
FIG. 7 is an illustration of a portion of the operation of the apparatus of FIG. 6.

Referring to FIG. 6, and with further reference to the latter of the two cross-referenced applications, control of a stiff receiver sheet is assisted by first and second sheet engaging devices 29 and 30. Referring to FIG. 7, sheet engaging devices 29 and 30 (FIG. 1) each preferably includes a shaft 32 carrying a pair of rollers 35 which engage the toner side of the sheet in margins 34 designed to permit such engagement without adverse affect on a loose toner image. If desired the rollers can be sprocket-like wheels, spur wheels or rollers with hubbles to provide improved images where such images extend out to what otherwise should be the border region. More specifically, a proposed toner image 33 is sized to fit on a receiving sheet 31 with significant margins 34 at each in-track side. Thus, if the receiver sheet is moved in the in-track direction of the arrow in FIG. 7, the rollers 35 can engage the toner side of the sheet in the margins 34 (generally parallel to the in-track direction) without disturbing toner image 33 which has not yet been fixed.

First sheet engaging device 29 is positioned just downstream of a set of corona chargers 23 (whose function will be described below). When a normal stiffness receiving sheet is separated by separation skive 19 from transfer member 11, it substantially follows the path of the upper surface of skive 19 toward fuser 40 because it is peeled off transfer member 11. However, a stiff receiver sheet has a tendency when separated by skive 19 to rotate upward toward corona charger 23. Any contact with charger 23 can disturb the image. Accordingly, first sheet engaging device 29 is positioned to intercept the leading portion of a stiff receiver sheet and prevent it from engaging charger 23. Because of the configuration of the image on the sheet providing margins 34, engaging device 29 does not affect the image. Engaging device 29 need not have a pair of rollers but could be stationary, non-rotatable guide pieces that are positioned to also engage margins 34.

It is important that the receiver sheet be firmly held to transfer member 11 for effective transfer by corona 17. Second sheet engaging devices 30 are positioned upstream of transfer corona 17 to urge the receiver sheet against transfer member 11 as it approaches the transfer area. Unlike the first sheet engaging device 29, the second sheet engaging device 30 is spring urged into contact with the transfer member.

It will be seen by someone skilled in the art that this principle could be applied in other places in the paper path of a stiff receiving sheet (or of a very flexible sheet). It should also be noted that it is known to use an endless belt for a transfer member, which endless belt generally traverses a path having sharper bends than does a transfer drum. A sheet engaging device such as device 30 is particularly useful in holding a stiff sheet to such a belt transfer member at its more curved turns.

Corona devices 22 and 23 are positioned to reduce electrostatic attraction of the receiver sheet to the transfer member 11 when a normal stiffness receiver sheet; i.e., a sheet of less than 28# bond weight, is used. With a normal, relatively flexible receiver sheet, separation of the sheet from the transfer member surface is difficult because of the strong electrostatic attraction between the sheet and the surface. An AC source 25 and a DC source 26 are used to essentially neutralize the two surfaces so that separation is easier.

However, when a stiff sheet is used, any immediate separation by the separation skive 19 is assisted by the beam strength of the sheet and the sheet has the tendency mentioned above of flapping up into the charger 23. At the trailing end of the sheet, separation can extend back into the transfer nip. It, thus, becomes desirable to attempt to hold the sheet to the transfer member rather than encourage its release. To effect this during the separation period, the AC corona is eliminated and a DC potential of the same polarity as the transfer corona 17 and of polarity opposite that of the toner image is applied by both chargers 22 and 23.

A logic and control 100 is programmed to provide this adjustment between the two conditions of the chargers 22 and 23.

It is known in the art to adjust conditions in an apparatus in response to code sensing on a cartridge, tray or a cassette. Paper supply 15 may include a cartridge, cassette 15*a*, tray or drawer that includes a stack of sheets, S, with a machine readable coding 54 indicative of the stiffness of the receiving sheets in the cartridge, tray or cassette. Coding 54 actuates a sensor 56 which signals logic and control 100 that stiff paper is in paper supply 15. Logic and control 100 then removes the AC voltage from the chargers 22 and 23 during separation of the sheet from transfer member 11 and inverts the polarity of the DC voltage applied by these chargers.

As described above, fuser 40 includes a first fusing member 44 which contacts the toner image to be fused and a second fusing member 45 which forms a heated pressure nip with the first fusing member 44. Both members are, in fact, rollers which are internally heated by a heating means 48 and 49. They are driven by a conventional motor 42 which has a transmission which is capable of driving the rollers at at least two speeds. Typically, the drive speed from the motor/transmission combination is adjustable so that the fuser can be slowed for fusing transparency stock where more heat is necessary.

A heavier weight receiver sheet coming from transfer member 11 reduces the temperature in the nip upon contact with the rollers substantially more than a normal sheet of paper would reduce it. This effect is pronounced in paper receiver sheets in excess of 40 pound bond weight (150 grams per square meter), especially 60 pound bond (225 grams per square meter) weight stock or heavier. Typically, the reduction in temperature sends a signal to the logic and control 100 to apply heat through heating means 48 and 49 according to a program adapted to the particular fuser 40 being used. Using sensor 56, the amount of heat added and temperature set points can be adjusted for the heavier stock. However, there is a lag in the recovery that is quite substantial with a thick receiver sheet. In high gloss applications, preferable for color imaging, a substantial change in total heat added to the image shows up as a variation in gloss in the image. The reduction in temperature is most noticeable as the roller 44 completes one revolution. It shows up as an abrupt reduction in gloss which is quite noticeable.

As described in the aforementioned cross-referenced applications, this problem is alleviated by utilizing the two speed drive embodied in motor 42 to drive the fusing rollers 44 and 45 at a first speed for the first revolution of the fusing roller contacting the image, first roller 44. As the first roller 44 completes its first revolution after entry of the receiving sheet into the nip, the speed of the fuser is abruptly reduced to compensate for the now cooled portion of the fusing roller beginning to contact the toner image. The reduction in speed greatly increases the thermal energy applied to the toner which compensates for the cooling of the surface by the first rotation in contact with the thick receiving sheet.

Timing can be accomplished in a number of ways. For example, a sensor 50 can be positioned a distance downstream of the nip equal to the circumference of first fusing roller 44. Actuation of the sensor 50 causes an immediate reduction in the speed of the motor 42. The reduction in speed could also be controlled in response to the abrupt reduction in temperature combined with knowledge of the rotation of roller 44. A preferred timing approach is to utilize a sensor 52 already in the nip to provide jam detection. The speed is then reduced a predetermined time after actuation of sensor 52. The time is, of course, dependent on the first speed and the circumference of roller 44.

If more than two revolutions of first fusing roller 44 are necessary to complete the fixing of the receiver sheet, the speed can again be reduced as the first fusing roller begins its third revolution. However, some compensation for the cooling of the surface by an increase in power to heating elements 48 and 49 takes effect by this time and such a further reduction in speed is not always necessary. In the preferred embodiment of the apparatus shown in FIG. 6, the receiver sheet is a ledger size sheet of 60 pound bond weight paper (225 grams per square meter), for example, 11×17 inches, with the in-track length being 17 inches. A 7½ inch circumference first fusing roller 44 would complete its second revolution two inches from the trailing edge of the sheet. Margins are provided at both the leading and trailing edges which in most instances is at least an inch at the trailing edge. It has been found that it is not necessary with this apparatus to provide the second reduction in speed for consistent high quality images.

The speed of the fuser (both fast and slow) can be adjusted according to the weight of the paper. For example, the sensing device 56 can again be used to slow the fuser when going between regular 20 pound bond paper and 60 pound bond paper.

In using image forming apparatus 1 for making greeting cards, it is assumed that the copy after appropriate trimming will be folded. For example, it may be folded in the center, making a four page card which would commonly have greetings, messages and pictures on the first three pages. With the use of photos and other extensive broad coloring for such cards, it is common that one of the pages will have a substantially more dense image than the page adjacent it on the other side of the fold. It is desirable that the more dense portion of the image receive the most reliable heavy fusing to provide the gloss desired for it, as well as to make sure that toner stacks are fully fused. Reliability in this respect can be assisted by feeding the sheet into the fuser with the most dense portion leading. The most dense portion of the image then is less affected by the cooling of the fusing rollers from contact with the sheet. Such image orientation can be accomplished by rotating both images electronically or by hand at the composing stage.

In duplex copying with a receiving sheet path such as that shown in FIG. 6, a receiving sheet must pass through the fuser 40 twice. The first toner image passes through the fuser twice while the second toner image only passes through once. It is generally known to reduce the amount of heat used in the first passage, for example, by speeding up the fuser, to a minimum amount to allow the sheet to be handled without smearing of the image. The heat is then increased for the second pass to finish the fusing of the first image and complete the entire fusing of the second image.

This approach of applying less heat to the receiver sheet the first time through the fuser is usable in many applications. Its use will depend on the difficulty of smearing the image and the effect on the paper of having it pass through the fuser twice at the regular speed. It is not desirable in all applications, for example, it may not be desirable with color images because of the difficulty preventing smearing of substantial stack heights in color toner images.

In either case, the first image will receive more heat in its two passes through the fuser than will the second image. Assuming that the texture of the surfaces of the rollers 44 and 45 are comparable, the first image will have a higher gloss than the second image.

This aspect of the FIG. 6 apparatus can be managed and even taken advantage of in forming the images. In many applications, it is more important for one image to be glossy than another. Although this concept is not limited to greeting cards, greetings cards are a particularly good example. Particularly sophisticated customized greeting cards may use more than one photo. Similarly, customization is also useful when no photos are being used. However, a very common and attractive utilization of customization in greeting cards involves the combination of a single photo with other greeting card graphics, including a customized message, a background and perhaps other decoration or drawings. In this last and very common situation, it is usually quite desirable to do the image containing the photo with as high a gloss as possible. The other image may be indifferent to gloss or even prefer a more matte finish. Thus, with the image forming apparatus shown in FIG. 6 in which one toner image receives more fusing heat than does the other toner image, it is important to choose which image to form first.

In its most basic sense, this feature can be utilized in an image forming apparatus that does not have a duplex path such as path 60 but in which duplex images are made by hand refeeding of the receiving sheet. In this case, the operator is given instructions to choose the image the operator prefers to be most glossy to form first. Then, the receiver sheet is removed from output tray 64 and placed in the top of paper supply 15 with the first image up. The receiver sheet then passes through the system again receiving the second image on the second side (downside in the paper supply) and the first image receives a second fusing that improves its gloss when it passes through the fuser.

The operator can be assisted in this process by an operator control panel (OCP) 90. For example, present operator control panels include display screens which will step-by-step lead an operator through a complex process with a copier or printer. If the operator decides to do duplex color with image forming apparatus 1, that information is input through OCP 90. OCP 90 then instructs the operator to compose first the image to have the highest gloss. After that image has been formed and fused, the operator is instructed to remove it from the output hopper 64 and place it first image-side face-up in paper supply 15 for copying a second side which the operator is advised is the "more matte" side. This basic instruction can be modified in many ways. For example, instead of suggesting that the glossy side be done first, the operator can be instructed to do the side with the photographic image first. The detail of the instruction would clearly depend on the expected sophistication of the operator.

FIG. 6 illustrates several alternative approaches to electronic image formation, each of which can be adapted to the other features of the apparatus. In its most basic form, the front end electronics are essentially the same as that on the KODAK COLOREDGE 1550+ Color Copier, referred to above, and on other available commercial image forming apparatus. In this basic apparatus, the image is composed by hand for a color scanner 95, the output of which is used with minimal electronic manipulation to control laser 6 in image formation. A greeting card with a combination of photo, message and other graphics can be made on such apparatus by cutting and pasting with one side being input through color scanner 95 in a single operation. The prompting from OCP 90 mentioned above is appropriate to such an apparatus.

A more sophisticated approach is also shown in FIG. 6 using a workstation 74 and page composition electronics 72 for composing each multicolor image for feeding to laser control electronics 70. In this instance, the image combining techniques disclosed in the above U.S. patent to Watkins et al are particularly usable to form images that combine messages, other graphics and photographic images into a single multicolor image. Again, suitable prompts to the operator at the workstation 74 suggesting that the image that is preferably most glossy be formed first, will assure the desired result with that image passing through fuser 40 twice. A preferred approach to such prompts would give the operator a choice between a glossy or a matte finish for the sides in question. One aspect of customization is to provide the customer with what he desires. In this instance, the customer may prefer to have the photographic image more matte and the other image more glossy. In such a case, the photographic side would be made last.

The choice may also be made automatically or by default. In this embodiment, the page composition electronics necessarily contains information associated with the makeup of each of both images. If only one of the images contains information from color scanner 95, that fact is necessarily known to page composition electronics 72. Page composition electronics 72 can then feed that page to laser control electronics 70 first. Other priorities can also be used. If both images contain material from color scanner 95, page composition electronics can be programmed to determine which material from color scanner 95 makes up the largest portion of its image.

Another preference useful in some situations is to determine which image has the largest area of a single color without detail. The extra fusing in making the first image glossy helps hide any grain shown in such areas. Thus, image analysis for such a characteristic is used to determine which image should be formed first. Sophisticated electronics is also available and can analyze a color image and distinguish the portion which has a photographic origin from the portion which is text or other graphics. Such image analysis could be used, not only in the more sophisticated approach using workstation 74 and page composition electronics 72, but also in the more basic approach in which the output of color scanner 75 is fed directly to laser control electronics and page composition is accomplished by cut and paste.

Figure 8:
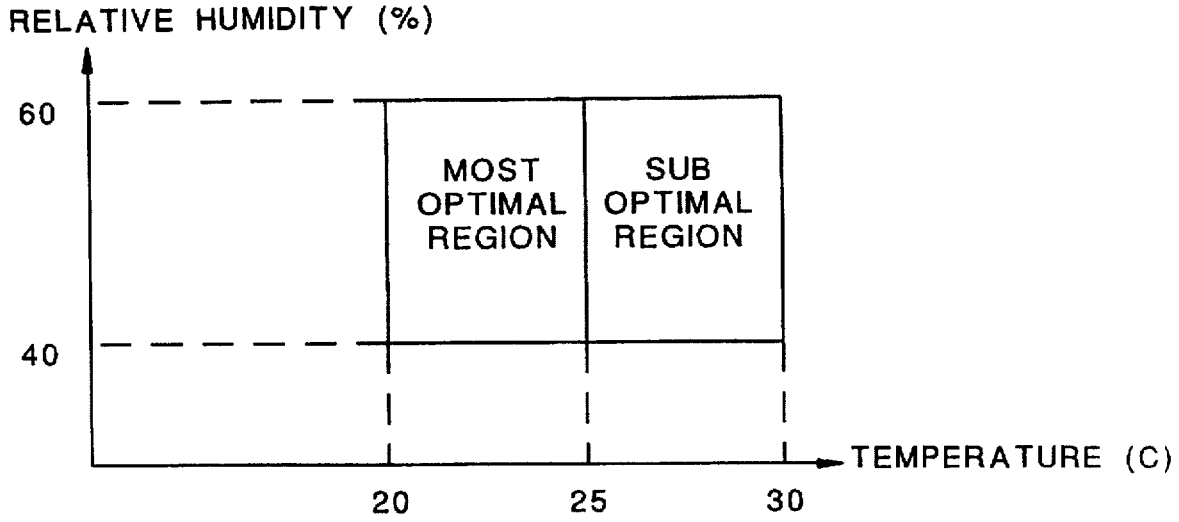
FIG. 8 is a graph illustrating ranges of relative humidity for best performance of the use of the receiver sheet of FIG. 1 in an electrophotographic apparatus of FIG. 6.

With reference to FIG. 8, there is provided a graph identifying relative humidity of apparatus environments for creating greeting cards on card stock in accordance with a color electrophotographic apparatus in accordance with the invention.

Figure 9:
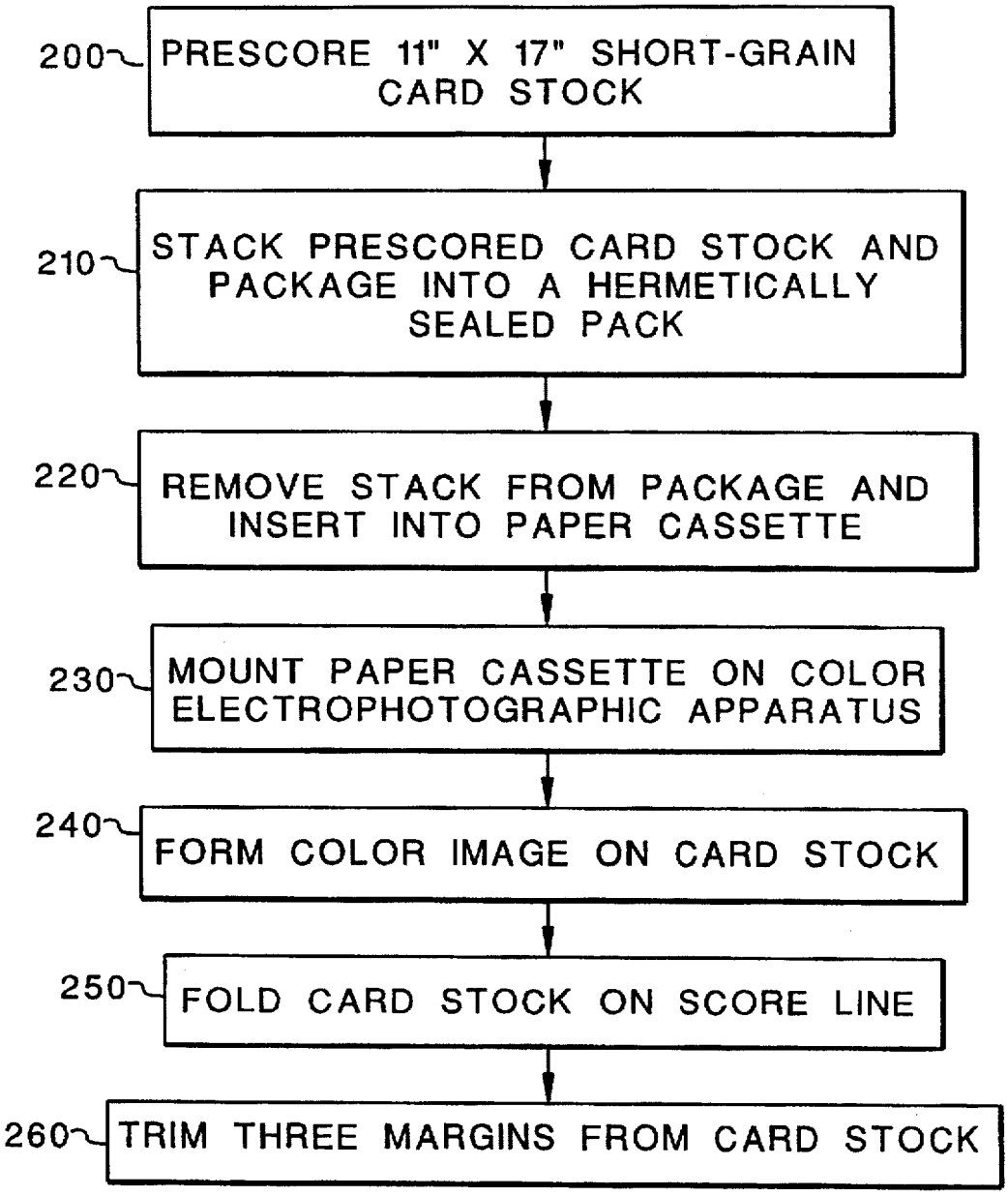
FIG. 9 is a flowchart of the improved method of the invention.
Figure 10:
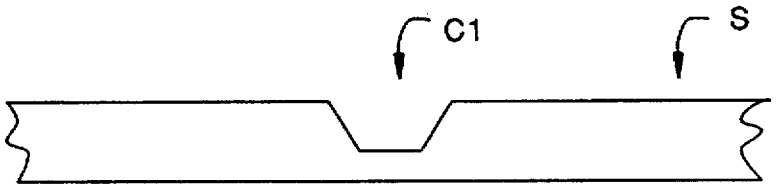
FIG. 10 is a sketch illustrating greatly enlarged an edge elevation view of a portion of a pre-half-cut receiver sheet as one example of a pre-scored receiver sheet for facilitating the creation of appealing fold lines in greeting cards or the like formed in accordance with the invention.
Figure 11:
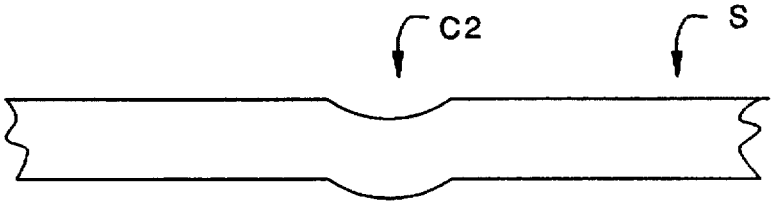
FIG. 11 is a sketch illustrating greatly enlarged an edge elevation view of a portion of a pre-creased receiver sheet as a second example of a pre-scored receiver sheet for facilitating the creation of appealing fold lines in greeting cards or the like formed in accordance with the invention.

With reference to the process flow steps illustrated in FIG. 9, the process of the invention is characterized by the following series of steps. In a first step 200, 11"×17" grain short card stock sheets are each subject to a pre-score operation at a midpoint of the sheet so that the pre-score line C is halfway between and parallel to the short edges of the sheet. Examples of pre-score lines as referred to herein are illustrated in the sketches of FIGS. 10 and 11. In FIG. 10, there is shown a preferred form of pre-score line which is a pre-half cut line C1. In forming a half-cut line in the paper, the depth of cut of the paper fibers may be more or less than half or equal to half the thickness of the paper sheet, S. In an example of an 11"×17" sheet of 59# bond weight, 10 or 11 mils thick, a half-cut line is best formed to a depth of about 5 mils (±1 mil) for use in the electrophotographic apparatus described above. A deeper cut than 6 mils may cause a buckling of the paper and adversely affect transfer. A shallower cut of say 4 mils or less may not provide as sharp and clean a fold line. A preferred apparatus for producing this half-cut line is the Thomson Die Cut Press made by Thomson National Press Company of Franklin, Mass. Other types of pre-score lines may be used. For example, there is shown in FIG. 11 a sheet, S, wherein a pre-crease C2 is formed in the sheet using a tool to provide an indentation to the fibers.

After each sheet is pre-scored, the sheets are preferably stacked into a stack of say 50, 100 or other convenient packagable amount for storage in a hermetically sealed environment. As noted above, the packaging may be either a single hermetically sealed wrapper or may include in addition a non-hermetic outer wrapper. Examples of hermetic wrapping materials are well known as are production means for drying papers to the low moisture content of less than 10% and preferably between about 5% to about 7% by weight. The wrapper on the package is provided with indicia indicating that it is half-cut paper or half-scored paper, the size of the paper, its weight, and identifying its suitableness for the electrophotographic color process such as a plain paper color copier or printer. The packages are shipped to customers' sites having the color electrophotographic apparatus or purchased by customers in stores, etc. At each site, a package is opened and the sheets placed into a paper cassette (a portion of which 15*a* is shown in FIG. 6) suited for this size paper or other paper supply support for the copier, step 220. Copiers/printers of the type described herein are known to have such cassettes. The cassette is mounted onto the color electrophotographic apparatus, step 230. Images for creation of a greeting card or the like are either supported on the scanner's exposure platen or provided by an electronic source, as described above. The electrophotographic apparatus is operated in accordance with the process described above to form images on the receiver sheet card stock, step 240. If a duplex card is to be provided, the card with the image on the first side is placed into the cassette or other original feeder (or automatically re-fed as described above) in proper orientation for production of an image on the second side. After the image or images are completely formed on the receiver sheet, the sheet is folded with the pre-scored side being on the outside of the card. The cards may be folded by hand or by an apparatus that takes one or more cards and folds and trims it, step 250.

After folding, the card is trimmed on three sides to remove the border or selvage to form the finished greeting card, step 260. Alternatively, the selvage may be removed and the card folded after trimming off of the border area. For certain images and certain size receiver sheets, there may not be a border area to trim off. In addition, the image area may be other than rectangular, for example, it could be round or heart-shaped and appropriate trim apparatus provided for removing borders to form cards of such shapes.

There has thus been shown that in accordance with the invention that significant advantages are provided in using pre-score card stock in a color EP engine although other reproduction processes may be used. After the color image is laid down on the paper, it is folded along the pre-score line. Then it is cut on 3 sides by a low cost cutter. The final result is a greeting card with high quality fold and cuts, similar to mass-produced, high quality, commercial cards.

Thus, the problem of rough low quality folds for greeting cards is successfully overcome without the need for expensive additional hardware for forming quality cards. The pre-scored heavy stock paper used in this invention will produce the highest quality folds. The pre-scored feature eliminates the need for expensive special machines that produce half-cut folds at the site where the greeting cards are produced. This allows for production of personalized high quality cards on the spot in a retail store.

The invention has been described in detail with particular reference to preferred embodiments thereof, but it will be understood that variations and modifications can be effected within the spirit and scope of the invention as described hereinabove and as defined in the appended claims.

We claim:

1. A method for producing a high quality folded printed card, the method comprising:

forming a toned electrostatographic image on an image supporting member of an electrostatographic recording apparatus;

feeding a discrete receiver sheet into engagement with the image supporting member for transfer of the image to the receiver sheet, the receiver sheet being of a card stock of the type having a weight of no less than 28# bond and having a pair of generally parallel first longer edges longer than a pair of generally parallel second shorter edges located generally perpendicular to the first edges, the grain of the sheet being in the grain short direction and the receiver sheet being fed into transfer relationship with the image supporting member by movement of the sheet in a direction coincident with the direction of the longer edges of the sheet, the receiver sheet including a score line which extends generally parallel to and intermediate the shorter edges to facilitate folding of the receiver sheet after formation of an image thereon;

transferring the image on the image supporting member to the receiver sheet;

fusing the image transferred to the receiver sheet; and folding the receiver sheet or a portion thereof having a border area removed with a fold line being along the score line.

2. The method of claim 1 and including trimming a border area around an image area to form the card.

3. The method of claim 2 and wherein the image supporting member transfers a multicolor image to the receiver sheet.

4. The method of claim 1 and including a step of unpackaging a package of plural receiver sheets similar in characteristics to said receiver sheet, said receiver sheets having a moisture content by weight of below 10% and mounting said receiver sheets in a position for feeding into said apparatus.

5. The method of claim 4 and wherein the moisture content is between about 5% and about 7%.

6. The method of claim 1 wherein the score line is a half-cut line.

7. A package of receiver sheets adapted for use in the method of claim 1, the package comprising:

a plurality of discrete receiver sheets arranged in a stack wherein each receiver sheet is of a card stock of the type having a weight of no less than 28# bond and having a pair of generally parallel first longer edges longer than a pair of generally parallel second shorter edges located generally perpendicular to the first edges, the grain of the sheet being in the grain short direction, the receiver sheet including a score line which extends generally parallel to and intermediate the shorter edges to facilitate folding of the receiver sheet after formation of an image thereon to form a high quality folded card.

8. The package of claim 7 wherein the scoring line is a half-cut line.

9. The package of claim 8 and including an enclosure means for enclosing the stack of receiver sheets for hermetically sealing the sheets from the environment external to the package.

10. The package of claim 7 and including an enclosure means for enclosing the stack of receiver sheets for hermetically sealing the sheets from the environment external to the package.

11. The package of claim 10 and including indicia on the package for identifying use of the receiver sheets in a copier or printer.

12. The package of claim 8 and including indicia on the package for identifying use of the receiver sheets in a copier or printer.

13. The package of claim 7 and including indicia on the package for identifying use of the receiver sheets in a copier or printer.

14. The package of claim 7 and including indicia on the package for identifying the receiver sheets as having a score characteristic and use of such sheets in a copier or printer.

15. A recording apparatus, comprising:

means for forming a toned electrostatographic image on an image supporting member of an electrostatographic recording apparatus;

a stack of discrete receiver sheets, each receiver sheet being of a card stock of the type having a weight of no less than 28# bond and having a pair of generally parallel first longer edges longer than a pair of generally parallel second shorter edges located generally perpendicular to the first edges, the grain of the sheet being in the grain short direction and including a score line which extends generally parallel to and intermediate the shorter edges to facilitate folding of the card stock after formation of an image thereon;

means for feeding discrete receiver sheets from the stack of such receiver sheets into engagement with the image supporting member, the feeding means being operative to feed each receiver sheet into transfer relationship with the image supporting member by movement of the sheet in a direction coincident with the direction of the longer edges of the sheet;

means for transferring the image on the image supporting member to the receiver sheet; and means for fusing the image transferred to the receiver sheet.

16. The apparatus of claim 15 wherein the score line is a half-cut line.

17. The apparatus of claim 16 wherein the apparatus is an electrophotographic apparatus for producing plural color images.

18. The apparatus of claim 15 wherein the apparatus is an electrophotographic apparatus for producing plural color images.

19. A method for producing high quality folded cards, the method comprising:

forming a toned unfused electrostatographic image on an image supporting member;

feeding a discrete receiver sheet into engagement with the image supporting member to transfer the toned image to the receiver sheet, the receiver sheet being of a card stock of the type having a weight of no less than 28# bond, the receiver sheet including a score line to facilitate folding of the receiver sheet after formation of an image thereon;

transferring the image on the image supporting member to the receiver sheet;

fusing the image to the receiver sheet; and folding the receiver sheet or a portion thereof having a border area removed with a fold line being along the scoring line.

20. The method of claim 19 and wherein the receiver sheet includes a plurality of parallel score lines.

21. A package of receiver sheets adapted for use in the method of claim 19, the package comprising:

a plurality of discrete receiver sheets arranged in a stack wherein each receiver sheet is of a card stock of the type having a weight of no less than 28# bond, the receiver sheets each including a plurality of parallel score lines to facilitate folding of the receiver sheet after formation of an image thereon to form a high quality folded card.

22. The package of claim 21 wherein the score line is a half-cut line.

23. The package of claim 22 and including an enclosure means for enclosing the stack of receiver sheets for hermetically sealing the sheets from the environment external to the package.

24. The package of claim 23 and including indicia on the package for identifying use of the receiver sheets in a copier or printer.

25. A package of receiver sheets adapted for use in the method of claim 19, the package comprising:

a plurality of discrete receiver sheets arranged in a stack wherein each receiver sheet is of a card stock of the type having a weight of no less than 28# bond, the receiver sheets each including a score line which extends generally parallel to and intermediate the shorter edges to facilitate folding of the receiver sheet after formation of an image thereon to form a high quality folded card.

26. The package of claim 25 wherein the score line is a half-cut line.

27. The package of claim 26 and including an enclosure means for enclosing the stack of receiver sheets for hermetically sealing the sheets from the environment external to the package.

28. The package of claim 27 and including indicia on the package for identifying use of the receiver sheets in a copier or printer.

29. A method for producing high quality folded cards, the method comprising:

forming an image upon a discrete receiver sheet, the receiver sheet being of a card stock of the type having a weight of no less than 28# bond, the receiver sheet including a score line to facilitate folding of the receiver sheet after formation of an image thereon; and folding the receiver sheet or a portion thereof having a border area removed with a fold line being along the score line.

30. A package of receiver sheets adapted for use in the method of claim 29, the package comprising:

a plurality of discrete receiver sheets arranged in a stack wherein each receiver sheet is of a card stock of the type having a weight of no less than 28# bond, the receiver sheets each including a score line to facilitate folding of the receiver sheet after formation of an image thereon to form a high quality folded card.

* * * * *

UNITED STATES PATENT AND TRADEMARK OFFICE

CERTIFICATE OF CORRECTION

PATENT No.: 5,729,820

DATED: March 17, 1998

INVENTOR(S): JAMZADEH et al.

It is certified that error appears in the above-identified patent and that said Letters Patent is hereby corrected as shown below:

On the Title Page - [56] References Cited add

-- FOREIGN PATENT DOCUMENTS
WO 93/18925 9/1993 WIPO --

Signed and Sealed this

Eighth Day of May, 2001

*Attest:*

Nicholas P. Godici

NICHOLAS P. GODICI

*Attesting Officer*

*Acting Director of the United States Patent and Trademark Office*